US008845397B1

(12) United States Patent
LeFever et al.

(10) Patent No.: US 8,845,397 B1
(45) Date of Patent: Sep. 30, 2014

(54) SURFACE ABRASION TOOL

(75) Inventors: Jason O. LeFever, Midland, TX (US); Dave A. Schultz, Cleburne, TX (US); Richard D. Ferguson, Fort Worth, TX (US); Al Paez, Fort Worth, TX (US)

(73) Assignee: AR Tips and Tools, Inc., Fort Worth, TX (US)

( * ) Notice: Subject to any disclaimer, the term of this patent is extended or adjusted under 35 U.S.C. 154(b) by 536 days.

(21) Appl. No.: 13/190,455

(22) Filed: Jul. 25, 2011

(51) Int. Cl.
*B24B 41/06* (2012.01)
*B24B 27/08* (2006.01)

(52) U.S. Cl.
USPC ..... 451/342; 451/359; 451/439

(58) Field of Classification Search
CPC ..... B24B 45/00; B24B 23/005; B24B 7/186; B24B 23/02; B24D 5/16; B27B 5/32
USPC ..... 451/357, 358, 359, 352, 343, 391, 439
See application file for complete search history.

(56) References Cited

U.S. PATENT DOCUMENTS

| | | | | | |
|---|---|---|---|---|---|
| 1,794,149 | A * | 2/1931 | Collins | 408/135 |
| 3,172,303 | A * | 3/1965 | Voller et al. | 74/570.21 |
| 3,604,271 | A * | 9/1971 | Matson | 73/458 |
| 3,893,372 | A * | 7/1975 | Strakeljahn | 409/180 |
| 4,099,552 | A * | 7/1978 | Dyball | 144/154.5 |
| 4,788,797 | A * | 12/1988 | Kane et al. | 451/344 |
| 8,162,726 | B1 * | 4/2012 | Jorgensen | 451/344 |

* cited by examiner

*Primary Examiner* — Timothy V Eley
(74) *Attorney, Agent, or Firm* — Handley Law Firm, PLLC

(57) ABSTRACT

A surface abrasion tool (12) has a first drive shaft (42) connect a motor (14) to a power transfer assembly (20). The power transfer assembly (20) transfers rotary power from the first drive shaft (42) to a second drive shaft (46) which is spaced apart from and parallel to the first drive shaft (42). A sanding disc (26) is secured to the second drive shaft (46). A linear drive means (16) is mounted in fixed relation to the motor (14) and selectively moves a pressure plate (22) relative to the sanding disc (26). A locating pin (28) extends from the pressure plate (22) in opposed relation to the sanding disc (26) and fits within a hole in a work piece. The linear drive means (16) is actuated to push the sanding disc (26) into a side of the work piece opposite the locating pin (28).

12 Claims, 2 Drawing Sheets

SURFACE ABRASION TOOL

TECHNICAL FIELD OF THE INVENTION

The present invention relates in general to power tools, and in particular to a powered tool for abrading a surface for bonding and or sealing against.

CROSS-REFERENCE TO RELATED APPLICATION

The present application is related to U.S. Provisional Patent Application Ser. No. 61/367,372, filed 23 Jun. 2010, invented by Jason O. LeFever, Dave A. Shultz, Richard D. Ferguson, Al Paez, and entitled "Surface Abrasion Tool."

BACKGROUND OF THE INVENTION

A powered tool is needed for abrading surfaces around holes in metal and composite plates for receiving adhesives and for sealing.

SUMMARY OF THE INVENTION

A novel, powered surface abrasion tool for one-handed operation is disclosed. The surface abrasion tool has a motor for providing a rotating spindle. A first drive shaft powered by the spindle connects to a power transfer assembly. The power transfer assembly transfers rotary power from the first drive shaft to a second drive shaft, which is offset to one side of the first draft shaft and preferably extends parallel to the first drive shaft. The second drive shaft is fixedly secured, that is secured in fixed relation, to a disc holder to which a sanding disc is fixedly secured, such that the sanding disc and the disc holder rotate in response to the motor rotating the spindle. A linear drive means is mounted in fixed relation to the motor. The linear drive means has a piston rod extending therefrom for selectively moving between a first position and a second position in response to actuation of the linear drive means. A guide plate is mounted in fixed relation to the motor. The guide plate has a plurality of bushings mounted therein. A plurality of slide rods corresponding to the guide bushings in the guide plate extend into respective ones of the guide bushings for slidably moving therein. A pressure plate is secured in fixed relation to the slide rods and the connecting piston rod. The pressure plate is moveable relative to the motor and the first and second drive shafts in response to actuation of the linear drive means. A locating pin is mounted in fixed relation to the pressure plate, in opposed relation to the sanding disc. The locating pin fits within a locating hole in a work piece (not shown) and the linear drive means is actuated to push the sanding disc into the work piece, as the sanding disc is being powered to rotate by the motor.

DESCRIPTION OF THE DRAWINGS

For a more complete understanding of the present invention and the advantages thereof, reference is now made to the following description taken in conjunction with the accompanying Drawings in which

FIG. 1 is a side view of the surface abrasion tool; and

FIG. 2 is a perspective, exploded view of the surface abrasion tool.

DETAILED DESCRIPTION OF THE INVENTION

Figure 1:
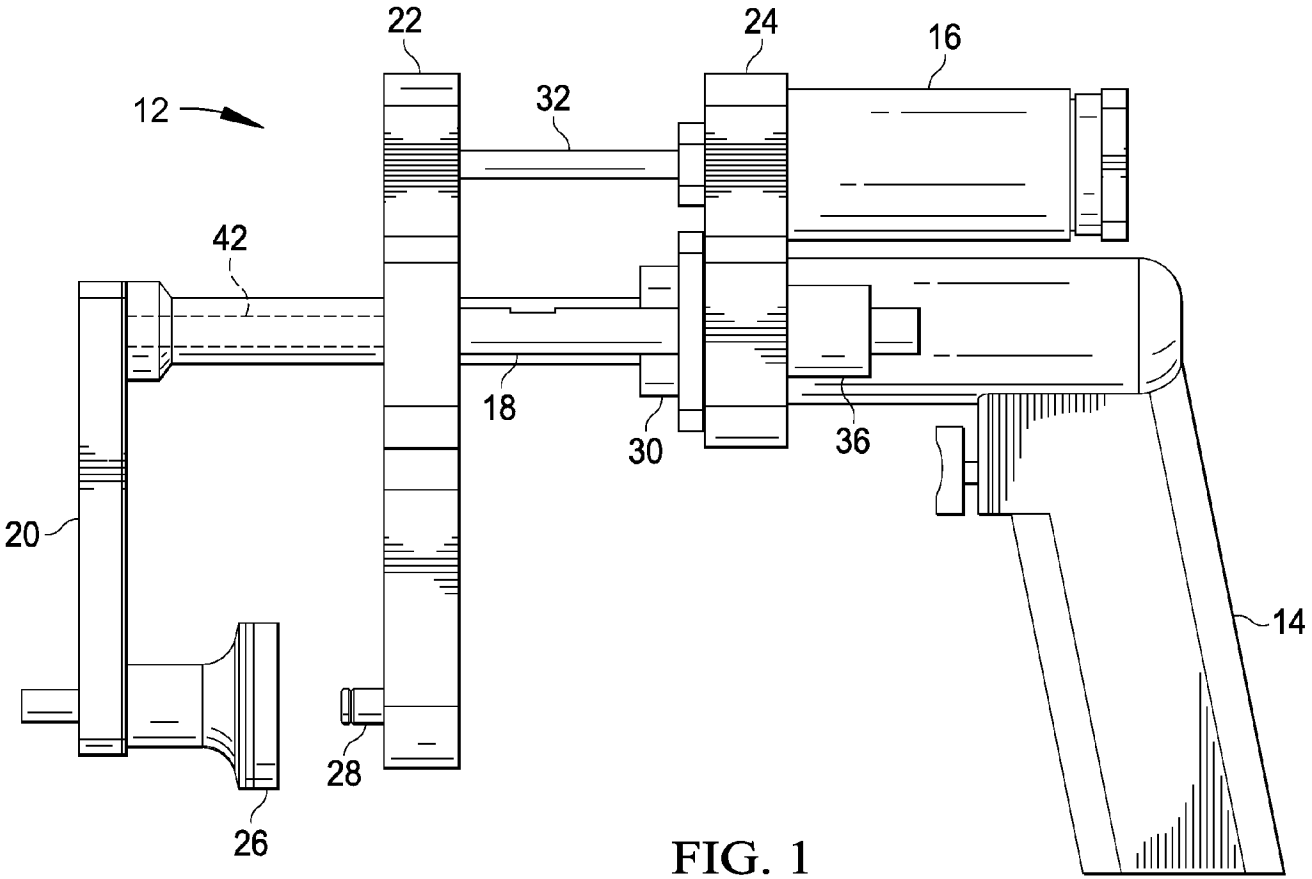
FIGS. 1 and 2 show various aspects for a surface abrasion tool made according to the present invention, as set forth below.
Figure 2:
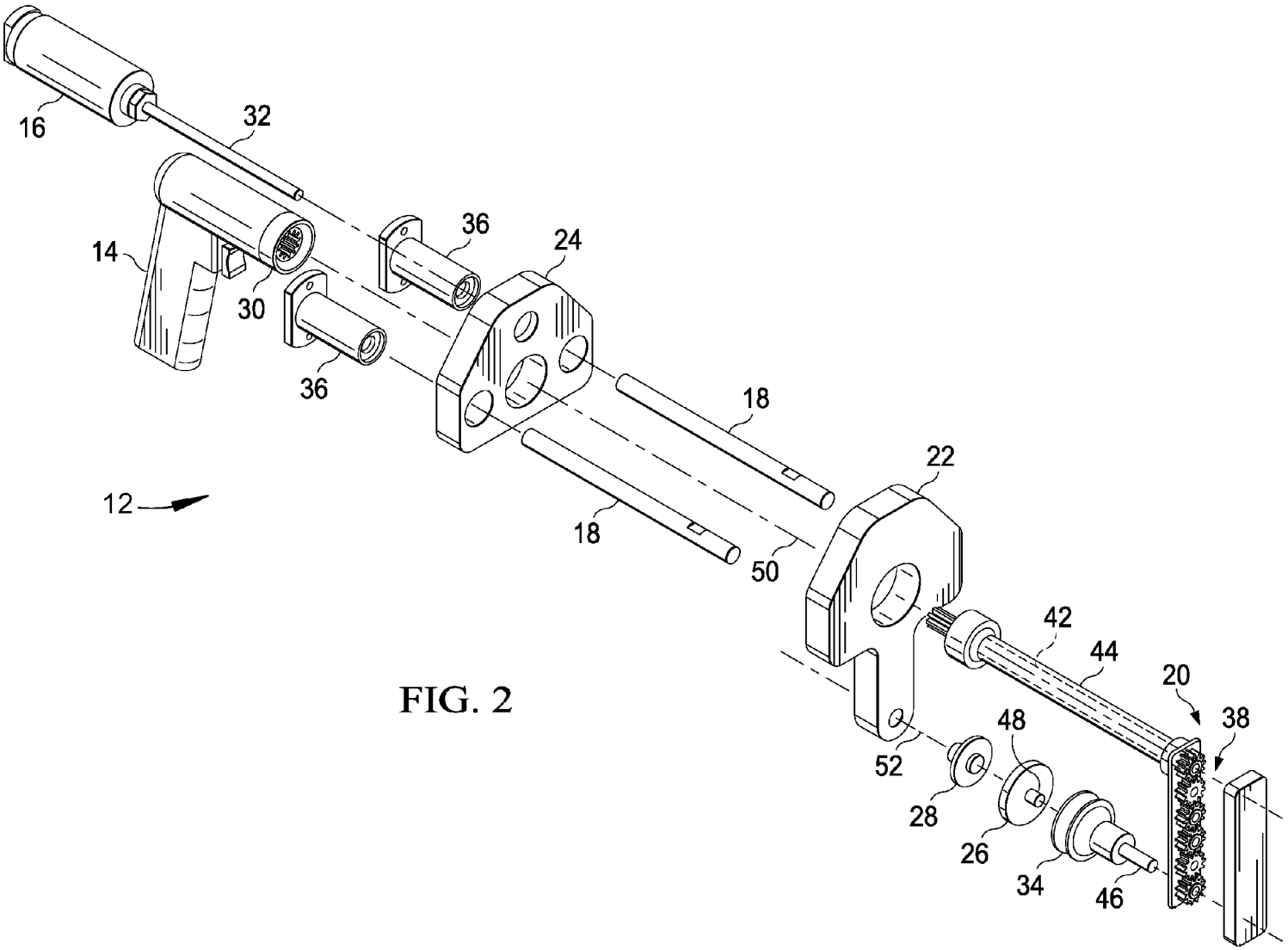

FIG. 1 is a side view and FIG. 2 is an exploded, perspective view of a surface abrasion tool 12, shown in the retracted position. The surface abrasion tool 12 is used to scuff the surface of a panel utilizing a single person's hand, which allows work pieces the opportunity to be bonded on metal or composite surfaces with good adhesion. The operator grabs hold of the surface abrasion tool 12 by wrapping their hand around a grip handle of the drill motor 14. The drill motor 14 is preferably a pneumatic motor, but in other embodiments may be electrically powered. The drill motor 14 has an ergonomic grip to allow for a person to position the surface abrasion tool 12 in any orientation they need for work piece alignment. A finger-type trigger is provided to allow a person to selectively power the drill motor 14. The surface abrasion tool 12 has a guide plate 24 mounted on the threads formed on an end of the drill motor 14 near a rotary spindle 30. The guide plate 24 is a machined aluminum bracket that allows multiple features to be adjusted. These adjustable features include an air cylinder 16 and a pair of slide rods 18.

The drill motor 14 has a rotating, or rotary, spindle 30. A first drive shaft 42 is located in a housing 44, and has a first end connected to the spindle 30 and a second end which connects to a power transfer assembly 20. The spindle 30 and the first drive shaft 42 rotate about a first axis 50, which extends longitudinally through the first drive shaft 42. The first drive shaft 42 is preferably a first elongate member having a longitudinal length which extends between the first and second ends, with the first axis 50 centrally disposed with the longitudinal length of the first drive shaft 42. A second drive shaft 46 is connected on one end to the power transfer assembly 20, and preferably provides a second elongate member which has a longitudinal length which is offset to one side of the longitudinal length of the first draft shaft 42, preferably extending parallel to the longitudinal length of the first drive shaft 42. The second drive shaft 42 is fixedly secured, that is secured in fixed relation, to a disc holder 34. A sanding disc 26 is fixedly secured to the disc holder 34. The sanding disc 26 has a threaded tab 48 which extends forward for fitting in a tapped/threaded hole in the rearward end of the sanding disc holder 34, opposite the second drive shaft 46. The second drive shaft 46, the sanding disc holder 34, and the sanding disc 26 preferably rotate about a second axis 52, which is centrally disposed with the longitudinal length of the second drive shaft 46.

A power transfer assembly 20 is preferably provided by a flat angel drill assembly. The power transfer assembly 20 has a plurality of gears 38 for transferring rotary power from the first drive shaft 42 to the second drive shaft 46, such that the sanding disc 26 and the disc holder 34 rotate in response to the motor 14 rotating the spindle 30. In the embodiment shown in FIGS. 1 and 2, the power transfer assembly has six of the gears 38 to offset the second drive shaft 46 from the first drive shaft 42, such that the second axis 52 about which the second drive shaft rotates is spaced apart and parallel from the first axis 50 about which the first drive shaft 42 rotates. The offset distance between the first axis 50 and the second axis 52, which correspond to an offset distance between the first drive shaft 42 and the second drive shaft 46, respectively, provides clearance between the housing 44 and the locating pin 28 to fit over a side of a panel or work piece being prepared for application of an adhesive. It should be noted that the number and size of the gears 38 may be varied for other embodiments to change the offset between the first and second axes 50 and 52 of the first drive shaft 42 and the second drive shaft 46, respectively.

An air cylinder 16 is mounted in fixed relation to the motor 14 and provides a linear drive means. The air cylinder 16 has a piston rod 32 extending therefrom for selectively moving between a first position and a second position in response to actuation of the linear drive means 16. The air cylinder 16 is designed to give the right amount of applied pressure needed to keep the locating pin 28 stationary so that the surface abrasion tool 12 can scuff the surface. The slide rods 18 which are also attached to the guide plate 24 serve the feature of making sure the locating pin 28 can repeat its position in every stroke. The air cylinder 16 provides a linear actuation means, and in other embodiments may be power by other means, such as electrically. The push button trigger on the drill motor 14 preferably actuates the air cylinder 16, by a pneumatically power air motor being used for the drill motor 14 and exhaust air from powering the drill motor 14 being used to power/actuate the air cylinder 16. That is, a single trigger on the drill motor 14 actuates rotary motion of the spindle 30 of the drill motor 14 and linear movement of the piston rod 32 of the air cylinder 16.

A guide plate 24 is mounted in fixed relation to the motor 14. The guide plate 24 has a plurality of bushings 36 mounted therein. A plurality of slide rods 18 corresponding to the guide bushings 36 in the guide plate 24 extend into respective ones of the guide bushings 36 for slidably moving therein.

A pressure plate 22 is secured in fixed relation to the slide rods 18 and the connecting piston rod 32. The pressure plate 22 is moveable relative to the motor 14 and the first and second drive shafts 42 and 46 in response to actuation of the linear drive means 16. The forward ends of the slide rods 18 are preferably threaded for fixedly securing into tapped/threaded holes (not shown) in the pressure plate 22. The length of the slide rods 18, as compared to the stroke of the air cylinder 16, are of sufficient length to prevent the slide rods 18 form disengaging from the bushings 36. The forward end of the connecting/piston rod 32 is threaded for fixedly securing into a tapped/threaded hole (not shown) in the pressure plate 22 to fixedly secure the forward end of the rod 32 to the pressure plate 22. A locating pin 28 is mounted in fixed relation to the pressure plate 22, in opposed relation to the sanding disc 26. The rearward end 50 of the locating pin 28 is threaded and fixedly secured within a threaded hold 52 in the lower end of a forward face of the pressure plate 22. The locating pin 28 fits within a locating hole in a work piece (not shown) and the linear drive means 16 is actuated to push the sanding disc 26 into the work piece, as the sanding disc 26 is being powered to rotate by the motor 14. The locating pin 28 is a designed aluminum insert that can be replaced with multiple sizes to fit different holes within the surface area. These inserts are removable and replaceable based on the size of the hole application. The pressure plate 22 allows these pins to be interchangeable based on the design.

The pressure plate 22 is attached to the piston rod 32 and the slide rods 18 so it can be repeatable in its positioning as the surface abrasion tool 12 strokes in and out. The piston 32 is the pressure bar within the cylinder 16 that brings the pressure plate 22 in and out with every stroke. Another integral piece to this surface abrasion tool 12 is the flat angle drill 20 which is attached to the spindle 30. This flat angle drill feature 20 has gears 38 inside of it that spin the sanding disc 26. The sanding disc 26 attached to the flat angle drill 20 is the abrasive attachment piece which actually scuffs the surface of the metal or composite allowing work pieces the opportunity to be bonded on the surface with no adhesion issues.

Thus the advantages of this invention provides a surface abrasion tool which may be used with one-handed operation, allowing parts to be held with a person's other hand. The surface abrasion tool has a locating pin for locating relative to a work piece being abraded a sanding disc which is powered to rotate by the surface abrasion tool.

Although the preferred embodiment has been described in detail, it should be understood that various changes, substitutions and alterations can be made therein without departing from the spirit and scope of the invention as defined by the appended claims.

What is claimed is:

1. A surface abrasion tool comprising:

a motor having a rotary spindle;

a first drive shaft powered by said rotary spindle;

a power transfer assembly for transferring rotary power from said first drive shaft to a second drive shaft, wherein said second drive shaft is spaced apart from a side of said first drive shaft and extends parallel to said first drive shaft;

said second drive shaft fixedly secured to a disc holder;

a sanding disc fixedly secured to said disc holder for rotating in response to said motor rotating said spindle;

a linear drive means mounted to said motor, said linear drive means having a piston rod extending therefrom for selectively moving between a first position and a second position in response to actuation of said linear drive means;

a guide plate mounted in fixed relation to said motor, said guide plate having a plurality of bushings mounted therein;

a plurality of slide rods corresponding to said guide bushings in said guide plate, said slide rods extending into respective ones of said guide bushings for slidably moving therein;

a pressure plate, said pressure plate being secured in fixed relation to said slide rods and said piston rod and moveable relative to motor and said drive shaft in response to actuation of said linear drive means;

a locating pin mounted in fixed relation to said pressure plate, in opposed relation to said sanding disc; and wherein said locating pin is disposed in opposed relation to said sanding disc, and said linear drive means is actuated to move said locating pin toward said sanding disc as said sanding disc is being powered by said motor.

2. The surface abrasion tool according to claim 1, wherein said first drive shaft has a first longitudinal length which rotates about a first axis and said second drive shaft has a second longitudinal length which rotates about a second axis, and said first and second axes are parallel and are spaced apart for receiving a side of a workpiece there-between.

3. The surface abrasion tool according to claim 2, wherein said motor is a pneumatic motor and said linear drive means is an air cylinder, and exhaust from said pneumatic motor is automatically applied to said air cylinder to actuate said air cylinder.

4. The surface abrasion tool according to claim 1, wherein said motor is a pneumatic motor and said linear drive means is an air cylinder, and exhaust from said pneumatic motor is automatically applied to said air cylinder to actuate said air cylinder.

5. A surface abrasion tool comprising:

a motor having a rotary spindle;

a first drive shaft powered by said rotary spindle, said first drive shaft having a first axis which extends longitudinally through said first drive shaft;

a second drive shaft having a second longitudinal axis which extends longitudinally through said second drive shaft, centrally disposed therein;

a power transfer assembly extending between said first drive shaft and said second drive shaft for transferring rotary power there-between, said power transfer assembly connecting to an end of said first drive shaft which is opposite said rotary spindle, and connecting to a first end of said second drive shaft;

a disc holder fixedly secured to a second end of said second drive shaft, wherein said second end of said second drive shaft is opposite said first end which is connected to said power transfer assembly;

a sanding disc fixedly secured to said disc holder for rotating with said disc holder and said second drive shaft;

a linear drive means mounted to said motor, said linear drive means having a piston rod extending therefrom for selectively moving between a first position and a second position in response to actuation of said linear drive means;

a guide plate mounted in fixed relation to said motor, said guide plate having at least one bushing mounted thereto;

at least one slide rod corresponding to said at least one guide bushing, said at least one slide rod extending into said at least one guide bushing for slidably moving therein, said slide rod extending substantially parallel to said first axis;

a pressure plate secured in fixed relation to said at least one slide rod and said piston rod and moveable relative to the motor and said drive shaft in response to actuation of said linear drive means, wherein said at least one slide rod supports said pressure plate relative to said motor in cantilever relation;

a locating pin mounted in fixed relation to said pressure plate, in opposed relation to said sanding disc; and wherein said locating pin is disposed in opposed relation to said sanding disc, and said linear drive means is actuated to move said locating pin toward said sanding disc as said sanding disc is being powered by said motor.

6. The surface abrasion tool according to claim 5, wherein said first axis and said second axis extend in parallel, spaced apart in a direction which is perpendicular to said first axis and said second axis, and said first drive shaft is powered by said motor to rotate about said first axis, which powers said power transfer assembly, which powers said second drive shaft to rotate about said second axis and turn said disc holder and said sanding disc.

7. The surface abrasion tool according to claim 6, wherein said motor is a pneumatic motor and said linear drive means is an air cylinder, and exhaust from said pneumatic motor is automatically applied to said air cylinder to actuate said air cylinder.

8. The surface abrasion tool according to claim 5, wherein said motor is a pneumatic motor and said linear drive means is an air cylinder, and exhaust from said pneumatic motor is automatically applied to said air cylinder to actuate said air cylinder.

9. A surface abrasion tool comprising:

a motor having a rotary spindle;

a first drive shaft powered by said rotary spindle, said first drive shaft having a first axis which extends longitudinally through said first drive shaft;

a second drive shaft having a second longitudinal axis which extends longitudinally through said second drive shaft, centrally disposed therein;

a power transfer assembly extending between said first drive shaft and said second drive shaft for transferring rotary power there-between, said power transfer assembly connecting to an end of said first drive shaft which is opposite said rotary spindle, and connecting to a first end of said second drive shaft;

a disc holder fixedly secured to a second end of said second drive shaft, wherein said second end of said second drive shaft is opposite said first end which is connected to said power transfer assembly;

a sanding disc fixedly secured to said disc holder for rotating with said disc holder and said second drive shaft;

a linear drive member mounted in fixed relation to said motor, said linear drive member having a piston rod extending therefrom for selectively moving between a first position and a second position in response to actuation of said linear drive member;

a guide plate mounted in fixed relation to said motor, said guide plate having two bushings mounted thereto;

two slide rods corresponding to respective ones of said two guide bushings and slidably extending into said respective ones of said two one guide bushings for slidably moving therein supported in cantilever fashion by said two bushings, and said two slide rods each having longitudinal lengths extending substantially parallel to said first axis;

a pressure plate secured in fixed relation to said slide rods and said piston rod and moveable relative to the motor and said drive shaft in response to actuation of said linear drive member, wherein said two slide rods support said pressure plate for moving relative to said motor;

a locating pin mounted to said pressure plate and extending therefrom in opposed relation to said sanding disc; and wherein said locating pin is disposed in opposed relation to said sanding disc, and said linear drive means is actuated to move said locating pin toward said sanding disc as said sanding disc is being powered by said motor.

10. The surface abrasion tool according to claim 9, wherein said first axis and said second axis extend in parallel, spaced apart in a direction which is perpendicular to said first axis and said second axis, and said first drive shaft is powered by said motor to rotate about said first axis, which powers said power transfer assembly, which powers said second drive shaft to rotate about said second axis and turn said disc holder and said sanding disc.

11. The surface abrasion tool according to claim 10, wherein said motor is a pneumatic motor and said linear drive means is an air cylinder, and exhaust from said pneumatic motor is automatically applied to said air cylinder to actuate said air cylinder.

12. The surface abrasion tool according to claim 9, wherein said motor is a pneumatic motor and said linear drive means is an air cylinder, and exhaust from said pneumatic motor is automatically applied to said air cylinder to actuate said air cylinder.

* * * * *